US010150004B1

(12) United States Patent
Price

(10) Patent No.: US 10,150,004 B1
(45) Date of Patent: Dec. 11, 2018

(54) SWIM FIN ADAPTED FOR WALKING

(71) Applicant: TailFins Sporting Goods Incorporated, Sasakatoon (CA)

(72) Inventor: Lee Roy Price, Saskatoon (CA)

(73) Assignee: Tailfins Sporting Goods Incorporated, Saskatoon (CA)

( * ) Notice: Subject to any disclaimer, the term of this patent is extended or adjusted under 35 U.S.C. 154(b) by 0 days.

(21) Appl. No.: 15/992,903

(22) Filed: May 30, 2018

Related U.S. Application Data

(60) Provisional application No. 62/512,357, filed on May 30, 2017.

(51) Int. Cl.
*A63B 31/11* (2006.01)

(52) U.S. Cl.
CPC ..... *A63B 31/11* (2013.01); *A63B 2031/112* (2013.01)

(58) Field of Classification Search
CPC ..... A63B 31/11
See application file for complete search history.

(56) References Cited

U.S. PATENT DOCUMENTS

| | | | | |
|---|---|---|---|---|
| 1,541,419 | A * | 6/1925 | Korving | A63B 31/11 217/3 BC |
| 2,277,538 | A * | 3/1942 | Breeze | A63B 31/11 441/63 |
| 5,374,210 | A * | 12/1994 | Sardella | A63B 31/11 441/64 |
| 6,866,615 | B2 * | 3/2005 | Ryland | A63B 31/11 441/64 |
| 9,039,470 | B1 * | 5/2015 | Berge | A63B 31/11 441/64 |
| 2009/0149093 | A1 * | 6/2009 | Grivna | A63B 31/11 441/61 |
| 2011/0014830 | A1 * | 1/2011 | Lan | A63B 31/11 441/64 |
| 2015/0343268 | A1 * | 12/2015 | Wiseman | A63B 31/11 441/64 |

FOREIGN PATENT DOCUMENTS

| | | | | |
|---|---|---|---|---|
| CN | 201491778 | | 6/2010 | |
| DE | 102007003508 | B3 * | 7/2008 | A63B 31/11 |
| WO | WO-02074395 | A1 * | 9/2002 | A43B 5/08 |
| WO | 2007095651 | | 8/2007 | |
| WO | 2010123345 | | 10/2010 | |
| WO | 2015089568 | | 6/2015 | |

* cited by examiner

*Primary Examiner* — Stephen P Avila
(74) *Attorney, Agent, or Firm* — Ryan W. Dupuis; Ade & Company Inc.; Kyle R. Satterthwaite

(57) ABSTRACT

A swim fin for wearing on a foot features lateral and medial side fins which do not extend further forwardly past a front end of a shoe portion of the swim fin, which forms a receptacle for receiving the foot. Also, the side fins are spaced from a sole of the shoe portion and located closer to an upper of the shoe portion than the sole.

20 Claims, 5 Drawing Sheets

SWIM FIN ADAPTED FOR WALKING

This application claims the benefit under 35 U.S.C. 119(e) of U.S. provisional application Ser. No. 62/512,357, filed May 30, 2017.

FIELD OF THE INVENTION

The present invention relates generally to swim fins wearable on feet of a user, and more particularly to such swim fins which are adapted for walking on a surface.

BACKGROUND

There exist prior art swim fins for wearing on the feet which are adapted with an attempt to make walking more comfortable.

However, in many such swim fins their side fins still extend forwardly past the toes of the wearer's foot and/or are located in a plane of the sole of the foot receiving cavity, thereby inhibiting a natural walking gait.

SUMMARY OF THE INVENTION

According to one aspect of the present invention there is provided a swim fin wearable on a foot of a user comprising:

a shoe portion having a sole for receiving part of the foot thereon and an upper supported spaced above the sole by a lateral side and a medial side of the shoe portion that are connected between the sole and the upper for forming a receptacle having a prescribed length extending in a longitudinal direction from a rear end to a front end of the shoe portion for receiving the foot of the user between the rear end and the front of the shoe portion;

the shoe portion including a heel band at the rear end of the shoe portion at a location spaced rearwardly from a rear edge of the upper so as to define an ankle aperture between the upper and the heel band opening transversely to the longitudinal direction of the shoe portion so as to be arranged to receive the foot passed through the ankle aperture in order to be received in the shoe portion;

the shoe portion including a toe aperture at the front end opening in the longitudinal direction of the shoe portion; and a lateral side fin and a medial side fin each on a corresponding one of the lateral and medial sides of the shoe portion so as to extend outwardly in opposing directions from the shoe portion to respective distal ends of the side fins spaced from shoe portion;

wherein the lateral and medial side fins each extend from a location at or adjacent the ankle aperture of the shoe portion towards and no further than the front end of the shoe portion; and wherein the lateral and medial side fins are located closer to the upper of the shoe portion than to the sole of the shoe portion.

This allows for the side fins to minimally interfere with walking, as they are set back from forward-most tips of the toes and spaced upwardly from the ground.

In one embodiment, the front end of the shoe portion, where the toe aperture is defined, is inclined relative to the longitudinal direction such that the shoe portion at the medial side extends further forwardly from the rear end than the lateral side of the shoe portion.

In such an embodiment, the front end of the shoe portion, where the toe aperture is defined, may be convexly curved across a width of the shoe portion.

Alternatively, the front end of the shoe portion may be linear across a width of the shoe portion.

Front ends of the lateral and medial side fins may follow a common path across a width of the swim fin that is substantially parallel to the front end of the shoe portion.

The common path may be curved and spaced from the front end of the shoe portion, which is also curved.

Preferably the front ends of the lateral and medial side fins follow a common curved path across a width of the swim fin which is substantially aligned with the front end of the shoe portion.

Thus, the shoe portion may be arranged to receive the foot such that the front end of the shoe portion and the path of the front ends of the side fins are substantially parallel with a bending axis at a ball of the foot. The ball of the foot is where heads of metatarsal bones are located.

A sole portion of the front end defining the toe aperture along a sole of the shoe portion may extend further forwardly than an upper portion of the front end defining the toe aperture along an upper of the shoe portion.

The swim fin may further include a heel aperture at or adjacent the rear end opposite the ankle aperture such that a heel of the foot protrudes therethrough when the foot is received in the shoe portion.

In the illustrated embodiment, the lateral side fin is wider than the medial side fin; however, in further embodiments, the lateral and medial side fins may be substantially symmetrical to one another.

Preferably the lateral and medial side fins are thickened at the lateral and medial sides of the shoe portion.

Preferably the lateral and medial side fins each include ribs extending in an outward direction from the shoe portion transversely to the longitudinal direction so as to provide stiffening to the side fin in the outward direction. The ribs may be sloped to extend in the outward direction at a forward slope.

The lateral and medial side fins are preferably thickened at their distal ends such that each side fin further comprises a stiffener member at the distal end thereof which is parallel to the longitudinal direction of the shoe portion.

Each of the lateral and medial side fins may be curved in the longitudinal direction from front to rear so as to have a convex upper surface and a concave lower surface.

Typically, the lateral and medial side fins extend linearly outwardly from the shoe portion to their distal ends.

Rears of the lateral and medial side fins may be spaced higher than fronts thereof above a plantar plane defined by the sole of the shoe portion.

Preferably a rear of the lateral fin extends further rearward than a rear end of the medial fin.

In some embodiments, the heel band is adjustable in length such that the prescribed length of the receptacle is adjustable.

The upper of the shoe portion may further include a strap member which is adjustably secured between the lateral side and the medial side such that a maximum circumference of the receptacle defined by the shoe portion is adjustable.

The upper of the shoe portion may also include a gusset of resilient material supported therein such that a circumference of the receptacle defined by the lateral side, the medial side, the upper and the sole is resiliently adjustable. When providing both a strap member and a gusset of resilient material on the upper, the strap member is preferably supported externally across the gusset of resilient material.

According to a further aspect of the invention there is provided a swim fin wearable on a foot of a user comprising:

a shoe portion having a sole for receiving part of the foot thereon and an upper supported spaced above the sole by a lateral side and a medial side of the shoe portion that are connected between the sole and the upper for forming a receptacle having a prescribed length extending in a longitudinal direction from a rear end to a front end of the shoe portion for receiving the foot of the user between the rear end and the front of the shoe portion;

the shoe portion including a heel band at the rear end of the shoe portion at a location spaced rearwardly from a rear edge of the upper so as to define an ankle aperture between the upper and the heel band opening transversely to the longitudinal direction of the shoe portion so as to be arranged to receive the foot passed through the ankle aperture in order to be received in the shoe portion;

the shoe portion including a toe aperture at the front end opening in the longitudinal direction of the shoe portion;

the front end of the shoe portion, where the toe aperture is defined, being inclined relative to the longitudinal direction such that the shoe portion at the medial side extends further forwardly from the rear end than the lateral side of the shoe portion; and a lateral side fin and a medial side fin each on a corresponding one of the lateral and medial sides of the shoe portion so as to extend outwardly transversely to the longitudinal direction from the shoe portion to respective distal ends of the side fins spaced from shoe portion;

wherein the lateral and medial side fins each extend from a rear of the side fin at a location at or adjacent the ankle aperture of the shoe portion towards a front of the side fin that is rearward of the front end of the shoe portion;

wherein the lateral and medial side fins are spaced upwardly from the sole of the shoe portion across a length thereof between the fronts and the rears of the side fins; and wherein the rears of the lateral and medial side fins are spaced higher than the fronts thereof relative to a plantar plane defined by the sole of the shoe portion.

Any of the earlier described features may be combined with one another.

BRIEF DESCRIPTION OF THE DRAWINGS

One exemplary embodiment of the invention will now be described in conjunction with the accompanying drawings in which.

In the drawings like characters of reference indicate corresponding parts in the different figures.

DETAILED DESCRIPTION

Figure 1:
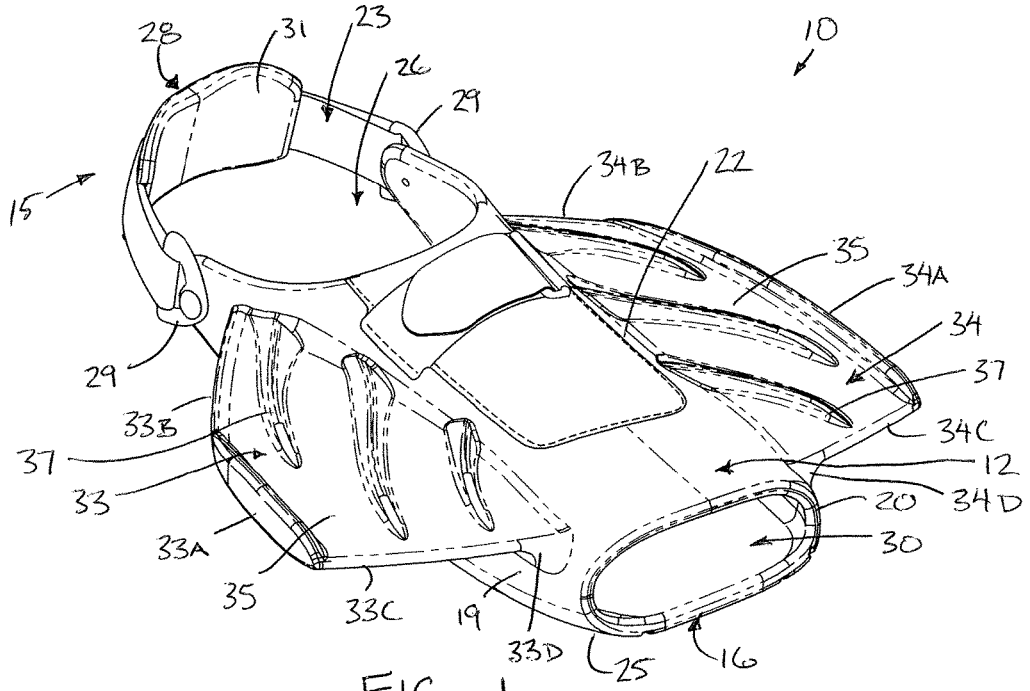
FIG. 1 is a perspective view from the front and a lateral side of the swim fin according to the present invention.
Figure 2:
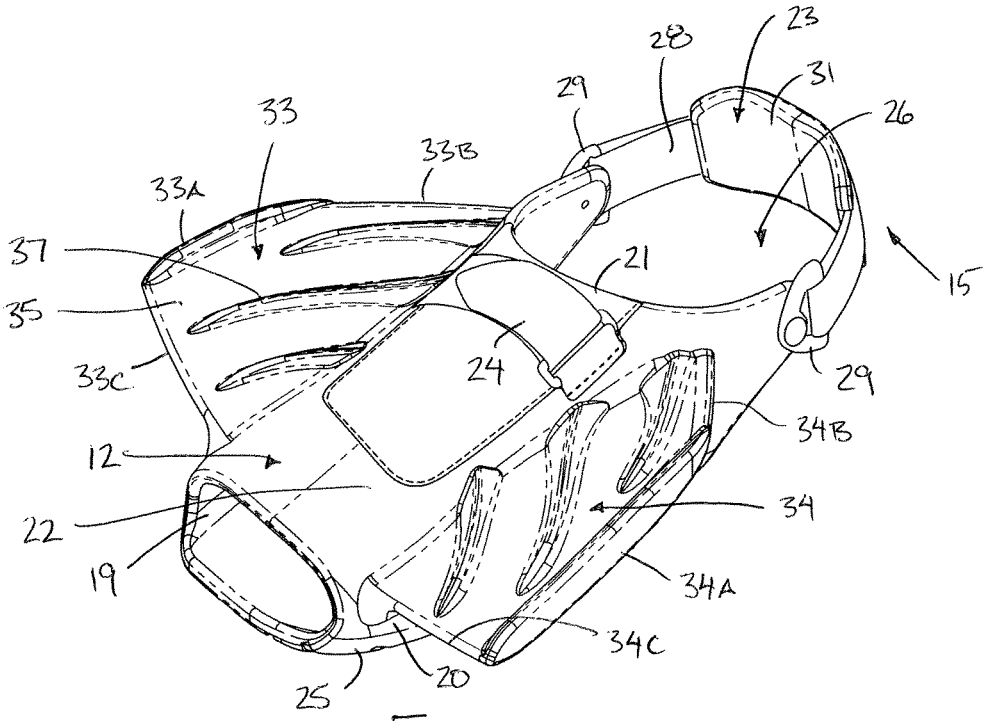
FIG. 2 is a perspective view from the front and a medial side of the swim fin according to the embodiment of FIG. 1.

There is illustrated in the accompanying figures a swim fin 10 wearable on a foot of a user (not shown) that is adapted for walking. It will be appreciated that although only one swim fin is described herein, which as illustrated is particularly suited for wearing on the right foot, swim fins are typically sold in pairs, and the opposite one of the pair is symmetrical to that illustrated herein.

The swim fin 10 comprises a shoe portion 12 that defines a receptacle 13 for receiving the foot. Thus, the receptacle 13 of the shoe portion 12 includes a rear end 15, which is at or adjacent a rear of a heel of the wearer's foot received in the shoe portion, and it extends longitudinally therefrom to a front end 16 of the receptacle. Additionally, the shoe portion has a lateral side 19 and a medial side 20 corresponding to a respective one of a lateral side of the foot (on the side of the little or pinky toe) and a medial side of the foot (on the side of the big or thumb toe).

Further, the shoe portion includes an upper 22 spanning from a rear edge at an ankle aperture 23 to the front end 16 of the shoe portion. The ankle aperture 23 is thus defined between the rear edge of the upper and a rear end of the shoe portion defined in further detail below, such that the ankle aperture opens transversely to a longitudinal direction of the shoe portion, and more specifically opens upwardly, such that the foot is passed initially through the ankle aperture toes first in order to be received in the shoe portion. The upper 22 is connected at a location spaced above a sole 25 of the shoe portion by the side walls of the lateral side 19 and the medial side 20 to collectively define a circumference of the shoe portion about the shoe receptacle that receives the foot of the user therein in use.

The upper 22 includes a gusset 21 of resilient material supported therein such that a circumference of the receptacle defined by the lateral side, the medial side, the upper and the sole is resiliently adjustable. In the illustrated embodiment, the sole 25, the medial side 20, the lateral side 19 and the majority of the upper are formed of common resilient material which is flexible, yet sufficiently stiff to substantially retain its shape and so as to provide minimal elastic stretch. The gusset 21, however, is formed of a softer and more elastic material, which can stretch much more readily than the material of the remainder of the shoe portion so that the circumference of the shoe receptacle can be readily adjustable at the region of the gusset.

The upper 22 further includes a strap member 24 which is adjustably secured between the lateral side and the medial side of the upper on opposing sides of the gusset 21. The strap member is adjustable in length and is less elastic than the gusset. Accordingly, the strap member defines a maximum circumference of the receptacle once the length of the strap member between opposing sides of the gusset has been selected by the user. In the illustrated embodiment, the strap member is fixed to the upper at one side of the gusset and passes through a ring structure fixed to the upper at the other side of the gusset so that the free end of the strap member can be secured at a range of locations along an intermediate portion of the strap member, for example using cooperating hook and loop fasteners. In alternative embodiments, the adjustable strap member 24 may be defined by laces, a quick ratchet system, or any other structure which is adjustable in length between opposing sides of the gusset.

The strap member is supported to span externally across the gusset of resilient material. In this manner, the gusset provides comfort for varying foot instep heights while protecting the top of the foot from the adjustable strap member that adjusts the foot cavity to different instep heights and different foot widths.

The sole 25 of the shoe portion that is opposite the upper 22, spans from a rear edge at a heel aperture 26 to the front end 16. The heel aperture 26 is opposite the ankle aperture 23 and opens in an opposite transverse direction thereto, opening downwardly, such that the heel of the foot protrudes therethrough when the foot is received in the shoe portion. The bottom surface of the sole 25 includes texture formed therein by a series of longitudinal and lateral grooves 27 across the sole between opposing ends and opposing sides of the sole. The grooves 27 thus define a tread pattern capable of channelling water longitudinally and laterally across the sole as the sole 25 undergoes a stepping motion against standing water on a ground surface across which the user walks, similar in function to the tread pattern on a vehicle tire.

In the illustrated embodiment both the ankle aperture 23 and the heel aperture 26 are at the rear end of the shoe portion such that the shoe portion forms a thin heel band 28 at the rear end, which is adapted to wrap from one side to the other about the rear of the wearer's heel. Although the heel band 28 may be integrally formed with the remainder of the shoe portion, in the illustrated embodiment, the heel band 28 is an adjustable strap connected at opposing ends to the lateral side and the medial side of the shoe portion respectively. The prescribed length of the shoe receptacle of the shoe portion is defined between the front end 16 of the shoe portion and the heel band 28 at the rear end 15 such that the prescribed length of the receptacle is adjustable when the heel band 28 comprises a strap that is adjustable in length as illustrated. A hinge member 29 couples each end of the heel band 28 to the respective side of the shoe portion such that the heel band 28 is pivotal about a common axis oriented in a lateral direction between the two hinge members 29. The strap of the heel band supports a heel cup 31 centrally thereon in which the heel cup is formed of a resilient block of material, for example an expanded foam material, having an ergonomic concave inner face for conforming readily to the shape of the heel of the foot of the user in a comfortable manner. Each of the opposing ends of the strap member forming the heel band 28 passes through a ring shaped structure on the respective hinge member 29 and is then secured adjustably along an intermediate portion of the strap, for example using cooperating hook and loop fasteners to allow the strap to be adjusted in length and to allow positioning of the heel cup between the opposing sides of the shoe portion to remain central as both ends of the strap are adjusted in length.

At the front end 16 of the shoe portion is defined a toe aperture 30 opening in the forward longitudinal direction. The front end 16 is spaced forwardly from the rear end 15 by a prescribed length L so that the shoe portion 12 is arranged to receive the foot. The swim fin 10 typically is worn such that toes of the foot do not substantially protrude beyond the front end 16, and such that a ball of the foot defined by location of heads of metatarsal bones is located spaced rearwardly of the front end 16 when the foot is received in the shoe portion. Typically, swim fins are produced and sold in a single size or a limited number of sizes, each intended to fit a respective range of different sizes of feet, such that the wearer's foot is retained in the shoe portion between the upper 22, the sole 25, and the band 28 at the rear end 15. Thus, toes of different wearers may stick out beyond the front end 16 by varying amounts, but generally speaking the ball of the foot is intended to be located within the shoe portion 12 in the vicinity of the front end 16. In such a manner the foot is substantially enclosed by the shoe portion 12, when received therein.

According to the illustrated embodiment, the shoe portion may be available in a few different sized configurations in which each size configuration relies on the adjustable heel band 28 to accommodate a range of feet having different shoe sizes. In addition, use of the resilient gusset 21 and strap member 24 combination to adjust the circumference of the shoe receptacle relative to the width or height of the foot of the user allows for a range of feet having different shoe widths or heights to be accommodated for as well.

Further to the shoe portion are provided lateral and medial side fins 33, 34 each on a corresponding one of the lateral and medial sides 19, 20 of the shoe portion. Each side fin 33, 34 forms a substantially rigid wing on one side of the shoe portion extending in a width direction transversely from the shoe portion to a free distal side 33A, 34A of the respective side fin. Each side fin also extends longitudinally of the shoe portion from a location spaced from the rear end 15 of the shoe portion, so as to be adjacent same in the illustrated embodiment, from a respective rear end 33B, 34B of that side fin to a front end 33C, 34C of the respective side fin which is located no further forward than the front end 16 of the shoe portion. More specifically, in the illustrated embodiment the front ends 33C and 34C are spaced rearwardly from the front end 16, and do not protrude forwardly thereof.

Figure 3:
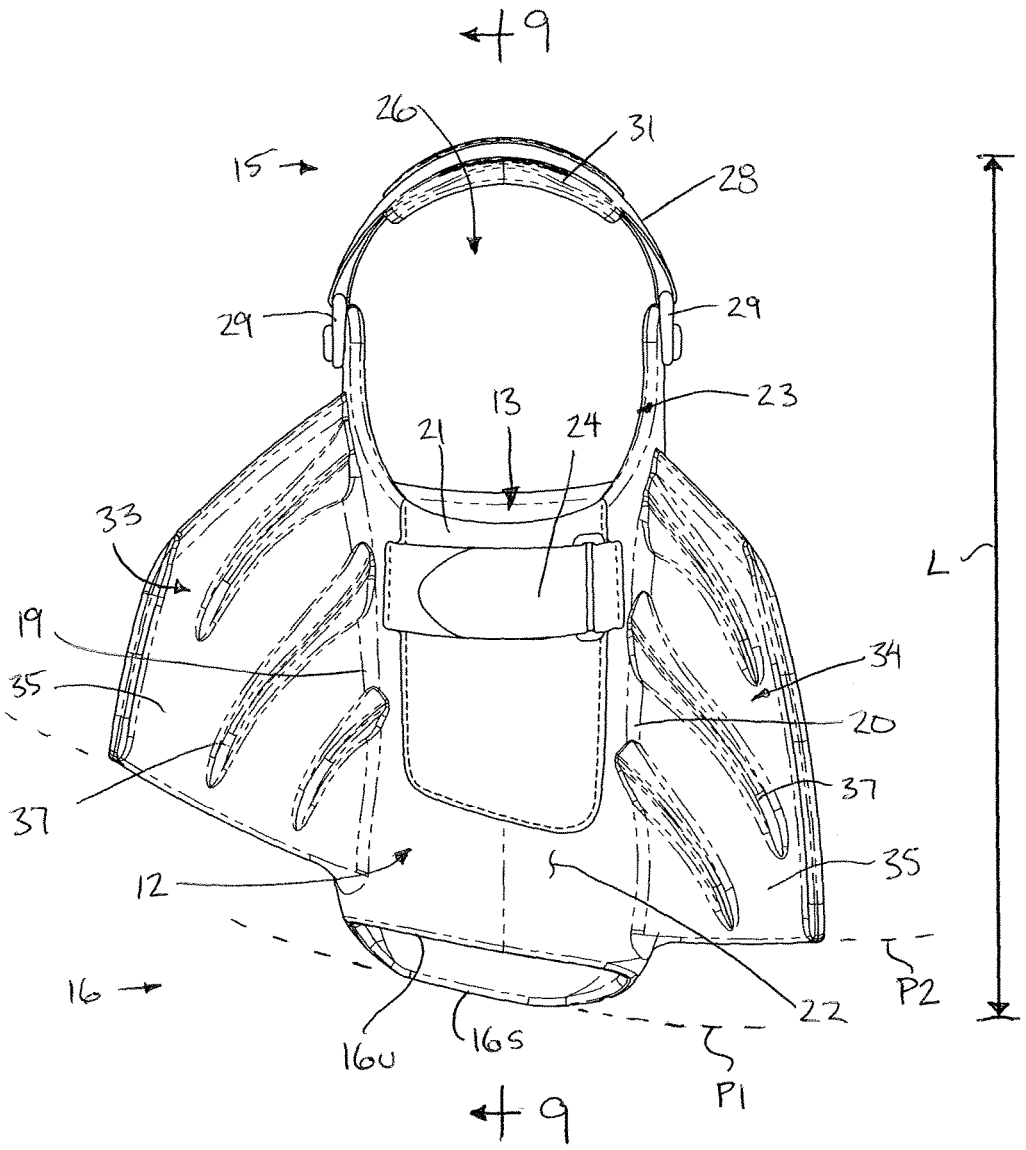
FIG. 3 is a top plan view of the swim fin according to the embodiment of FIG. 1.
Figure 4:
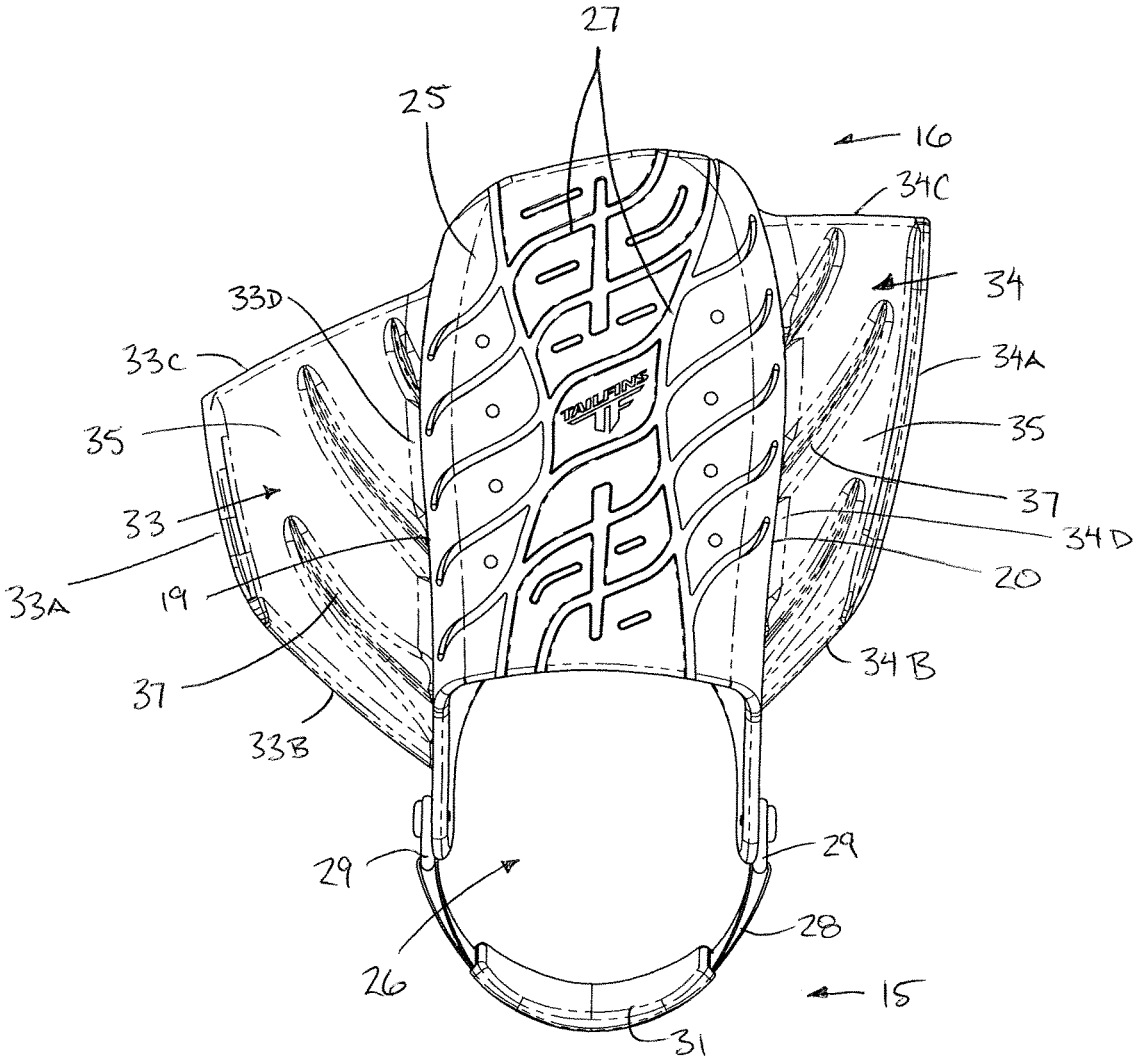
FIG. 4 is a bottom plan view of the swim fin according to the embodiment of FIG. 1.

As more clearly shown in FIGS. 3 and 4, in order to be better suited for walking, the front end 16 of the shoe portion is shaped so as to correspond to the ball of the foot, which is not perpendicularly transverse to the longitudinal direction. The ball of the foot, which is the padded portion of a sole of the foot between the toes and the arch of the foot, general defines a bending axis of the foot whereat, during walking gait, the metatarsal bones of the foot pivot upwardly relative to the foot's phalange bones which remain planted on the support surface. The foot may be considered to have a longitudinal axis extending from the heel through a second or pointer toe which is adjacent the big innermost toe. The foot bending axis is transverse to this longitudinal axis, and inclined relative thereto such that the head of the metatarsus leading to the big toe is further forwardly of the heel than the head of the metatarsus leading to the pinky toe. This bending axis is an approximate axis extending through a convex arcuate path connecting the heads of the metatarsal bones from the medial to the lateral side of the foot. As such, the front end 16 is inclined relative to the longitudinal direction such that the shoe portion at the medial side 20 extends further forwardly from the rear end 15 than the lateral side 19 of the shoe portion 12. More specifically, the front end is convexly curved, as indicated by dashed line P1, across a full width of the shoe portion from the medial side 20 to the lateral side 19, which more closely approximates a shape of the ball of the foot than for example a front end with linear extent from one side to the other. The sole portion of the shoe portion is sufficiently flexible to follow the flexing of the foot of the user during bending and thus defines a bending axis of the sole portion in which the bending axis extends transversely across the width thereof at the front end of the shoe portion for alignment parallel to the bending axis of the foot of the user. In the illustrated embodiment, a sole portion 16S of the front end, which defines the toe aperture 30 along the sole 25 of the shoe portion, extends further forwardly than an upper portion 16U of the front end, which defines the toe aperture along the shoe portion's upper 22, and this may improve bending of the shoe portion in accordance with walking gait.

The rear ends 33B, 34B of the side fins each extend to the respective side away from the shoe portion and forwardly so as to be inclined relative to the longitudinal direction of the shoe portion and in an opposite manner to the other side fin rear end.

To avoid inhibiting the bending of the foot in walking gait, the front ends 33C, 34C of the lateral and medial side fins 33, 34 follow a common arcuate path across a full width of the swim fin, from one distal side 33A to the other distal side 34A, as indicated by dashed line P2, that is parallel to the curved shape or path P1 of the front end 16 of the shoe portion. That is, the front end of each side fin defines and lies along the arcuate path P2. If the front ends 33C, 34C of the side fins were located at the front end instead of being set back rearwardly therefrom as in the illustrated embodiment, the paths P1 and P2 further would define a common arcuate path. The path P1 defined by the front end 16 is arranged to follow the curvature of the bending axis of the foot so as to make walking while wearing the swim fin 10 easier as the former is forward of and adjacent to the latter. It will be appreciated that, in the illustrated embodiment, the path P2 followed by the front ends 33C and 34C of the side fins is spaced rearwardly of the path P1 followed by front end 16 of the shoe portion but only slightly such that the front ends of the lateral and medial side fins are still substantially aligned with the front end of the shoe portion.

The lateral and medial side fins 33, 34 are wholly spaced from the sole 25 of the shoe portion including the thickened distal ends 33A and 34A which flare upwardly and downwardly from a main body 35 of the respective side fin. More specifically, the side fins are located closer to the upper 22 and the sole 25 in an intermediate location therebetween. The shoe portion 12, which defines a tubular receptacle from the front end 16 to each of the ankle aperture 23 and the heel aperture 26, is rounded from the sole 25 to the upper 22 at each of the lateral and medial sides 19, 20, and in the illustrated embodiment the side fins 33, 34 meet the shoe portion where a wall of the receptacle slopes upwardly and inwardly towards a center of the upper 22. As such, the side fins 33, 34 do not interfere with walking gait particularly when the foot may roll from one side to the other (typically from the medial towards the lateral).

In the illustrated embodiment the lateral side fin 33 is wider in width from the lateral side 19 of the shoe portion to the distal side 33A of the fin than the medial side fin 34 is from the medial side 20 to the distal side 34A. As such the fins collectively provide sufficient surface area to enhance swimming, as is the purpose of wearing swim fins on the feet, while the medial side fin is sized smaller so that the wearer may walk with his/her feet spaced apart at a comfortable width.

Both side fins are similar in length though the lateral side fin 33 is slightly longer than the medial side fin 34. The front end 34C of the medial side fin is further forward of the rear end 15 than the lateral side fin's front end 33C, and accordingly in the illustrated embodiment the rear end 34B of the medial side fin is further forward of the rear end 15 than the lateral side fin's rear end 33B.

Along its distal end 33A the lateral side fin is shorter in length as compared to the medial side fin 34 at 34A, such that the lateral side fin's rear end 33B extends furthers forwardly than that of the medial side fin. This, in addition to the front end 33C of the lateral side fin extending rearwardly from the lateral side 19 to the distal end 33A as opposed to substantially transversely perpendicularly to the side of the shoe portion as in the case of the medial side fin, may provide for both side fins 33, 34 to be similar in surface area at their main bodies despite their difference in shape. The lateral side fin 33 is substantially trapezoidal in shape, while comparatively the medial side fin 34 is substantially rectangular in shape.

Each side fin 33, 34 includes reinforcing ribs 37 on top and on the bottom of the main body 35, each at a spaced location thereon. The ribs 37, each of which is substantially triangular in plan view, extend at a slope to the longitudinal direction so as to extend transversely outwardly and forwardly from the respective side 19, 20 of the shoe portion to a location spaced inwardly from an outer periphery of the side fin defined by its distal, rear, and front ends respectively appended A B and C herein after the reference numeral corresponding to the side fin. The ribs act to stiffen the respective side fin against bending across its width. Furthermore, in the illustrated embodiment, all ribs effectively meet the wall of the shoe portion thus acting to reduce and limit bending of the side fin relative to the shoe portion.

The ribs 37 in the illustrated embodiment are curved so as to be nearer to parallel to the longitudinal direction at the outer ends farthest from the shoe portion than at the inner ends joined to the shoe portion. The distal ends of the ribs are thus at a smaller slope relative to the longitudinal direction than the proximal ends of the ribs. In this manner, flow of water around the shoe portion is initially directed outwardly in a lateral direction from the shoe portion across the top and bottom faces of the side fins by the proximal ends of the ribs, followed by redirecting the flow across the faces of the side fins to flow more longitudinally towards the front edges of the side fins at the distal ends of the ribs respectively.

The side fins are also thickened on top and on bottom at their proximal ends 33D, 34D at the shoe portion so as to rigidify connection thereto. More particularly, the proximal ends of the side fins are thicker than the thickness of the main portion of each side fin. The ribs 37 extend from these thickened proximal ends 33D, 34D outwardly to a spaced location from the outer periphery of the respective side fin. The ribs also define regions which are thicker in height than the thickness of the main portion of each side fin between the upper and lower faces thereof.

Yet further, the distal ends 33A, 34A of the side fins are thickened in the longitudinal direction of the shoe portion so as to define a stiffener member extending in the longitudinal direction of the shoe portion to resist bending in the longitudinal direction particularly at or adjacent the outer peripheries of the side fins. The distal ends 33A, 34A are rounded at their forward-most tips to a maximum thickness, from which the thickness then tapers towards the rear end of the respective side fin so as to generally tear-drop shaped.

Figure 5:
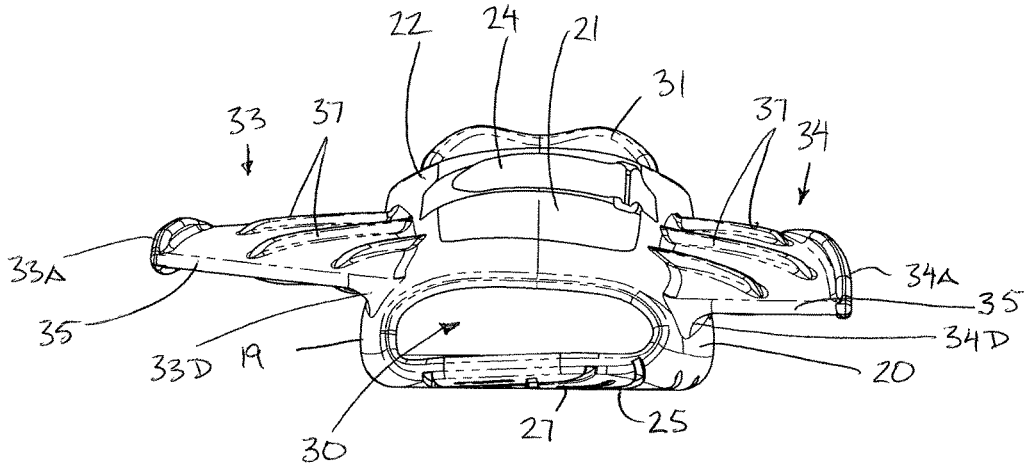
FIG. 5 is a front elevational view of the swim fin according to the embodiment of FIG. 1.
Figure 6:
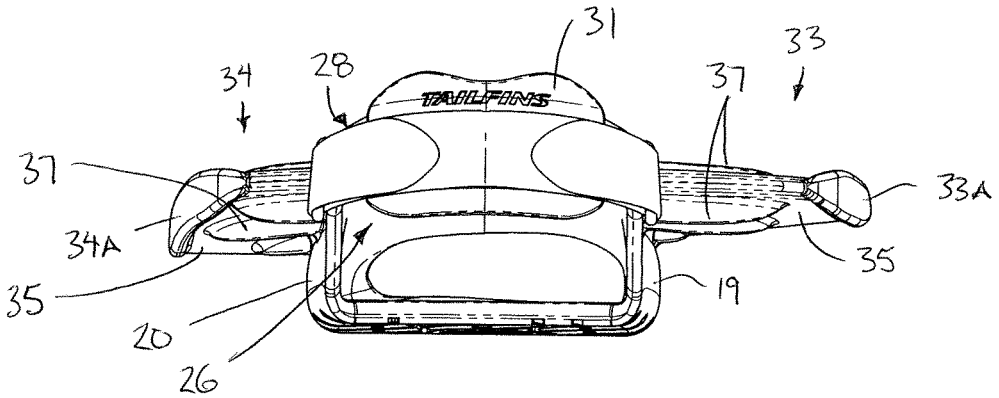
FIG. 6 is a rear elevational view of the swim fin according to the embodiment of FIG. 1.
Figure 7:
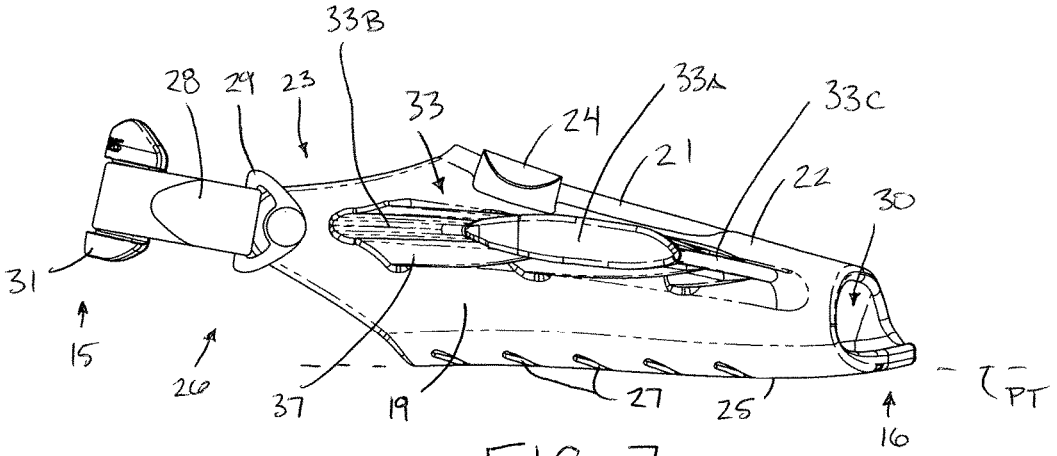
FIG. 7 is a lateral side elevational view of the embodiment of FIG. 1.
Figure 8:
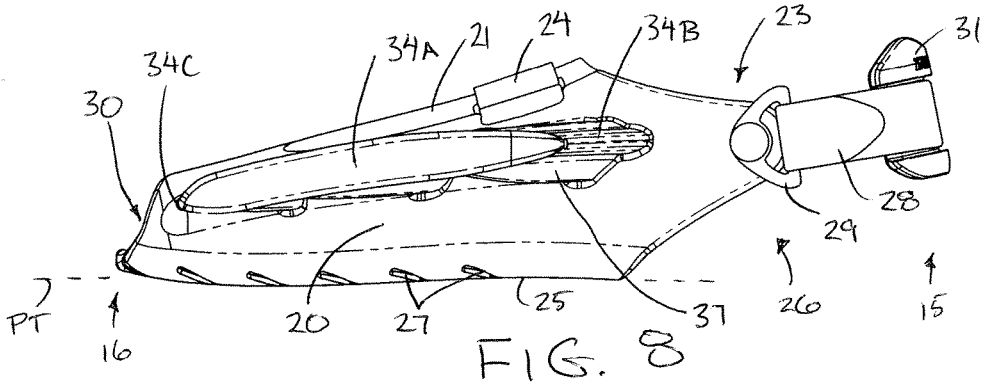
FIG. 8 is a medial side elevational view of the swim fin according to the embodiment of FIG. 1.
Figure 9:
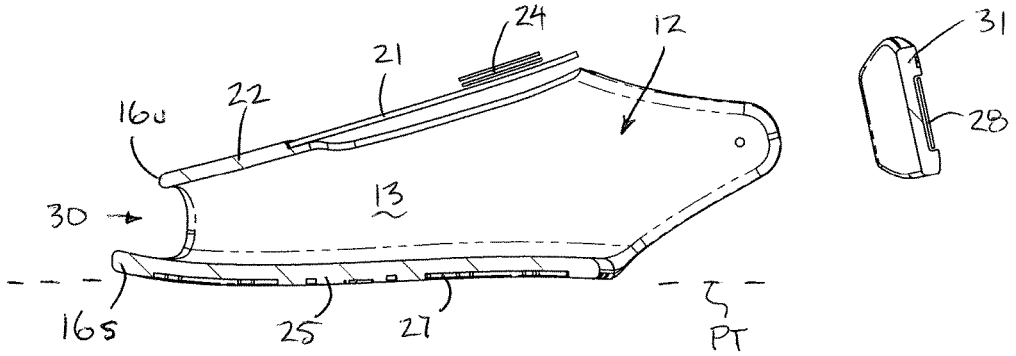
FIG. 9 is a cross-sectional view along line 9-9 in FIG. 3.

The rear and front ends of the side fins are not raised above the main body 35 which may aid water flow in the longitudinal direction along the respective side fin, which during swimming occurs from the rear end to the front end of the side fin. However, the side fins are thinner at their wider front ends 33C, 34C and thicker at their narrower rear ends 33B, 34B, as more clearly shown in FIGS. 5 and 6.

Thus, the lateral and medial side fins 33, 34 are self-supported and relatively stiff.

The main body 35 of each side fin is convexly curved (relative to the sole 25) in the longitudinal direction from rear to front end, but is not curved from proximal to distal end so that the respective side fin extends linearly outwardly from the shoe portion. Thus is provided a convex upper surface 35A and a concave lower surface 35B.

The flared distal ends 33A, 34A of the side fins, each of which extend upwardly from the upper surface 35A and downwardly from the lower surface 35B of the respective side fin so as to form an upstanding wall above and below the main body 35, act to channel water in the longitudinal direction during swimming.

The front ends 33C, 34C are located closer than the rear ends 33B, 34B to a horizontal plantar plane PT of the shoe portion defined by the sole 25, particularly at its center which in the illustrated embodiment is lower than the lateral and medial sides of the sole. The plantar plane PT is parallel to a plane defined by that portion of the sole of the wearer's foot which is rearward of the ball of the foot and separates same from a support surface during walking.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A swim fin wearable on a foot of a user comprising:

a shoe portion having a sole for receiving part of the foot thereon and an upper supported spaced above the sole by a lateral side and a medial side of the shoe portion that are connected between the sole and the upper for forming a receptacle having a prescribed length extending in a longitudinal direction from a rear end to a front end of the shoe portion for receiving the foot of the user between the rear end and the front of the shoe portion;

the shoe portion including a heel band at the rear end of the shoe portion at a location spaced rearwardly from a rear edge of the upper so as to define an ankle aperture between the upper and the heel band opening transversely to the longitudinal direction of the shoe portion so as to be arranged to receive the foot passed through the ankle aperture in order to be received in the shoe portion;

the shoe portion including a toe aperture at the front end opening in the longitudinal direction of the shoe portion; and a lateral side fin and a medial side fin each on a corresponding one of the lateral and medial sides of the shoe portion so as to extend outwardly in opposing directions from the shoe portion to respective distal ends of the side fins spaced from shoe portion;

wherein the lateral and medial side fins each extend from a location at or adjacent the ankle aperture of the shoe portion towards and no further than the front end of the shoe portion; and wherein the lateral and medial side fins are located closer to the upper of the shoe portion than to the sole of the shoe portion.

2. The swim fin according to claim 1 wherein the front end of the shoe portion, where the toe aperture is defined, is inclined relative to the longitudinal direction such that the shoe portion at the medial side extends further forwardly from the rear end than the lateral side of the shoe portion.

3. The swim fin according to claim 1 wherein the front end of the shoe portion, where the toe aperture is defined, is convexly curved across a width of the shoe portion.

4. The swim fin according to claim 1 wherein front ends of the lateral and medial side fins follow a common path across a width of the swim fin that is sloped rearwardly from the distal end of the medial side fin to the distal end of the lateral side fin.

5. The swim fin according to claim 1 wherein the toe aperture is defined between a front end of the sole and a front end of the upper, and wherein the front end of the sole extends further forwardly than the front end of the upper of the shoe portion at the toe aperture.

6. The swim fin according to claim 1 wherein the lateral side fin is wider than the medial side fin such that the distal end of the lateral side fin is farther from the shoe portion than the distal end of the medial side fin.

7. The swim fin according to claim 1 wherein the lateral and medial side fins are thickened at the lateral and medial sides of the shoe portion relative to a main body thickness of the side fins.

8. The swim fin according to claim 1 wherein the lateral and medial side fins each include ribs extending in an outward direction from the shoe portion transversely to the longitudinal direction so as to provide stiffening against bending of the side fin in a direction transverse to the longitudinal direction of the shoe portion.

9. The swim fin according to claim 8 wherein the ribs are sloped to extend in the outward direction at a forward slope.

10. The swim fin according to claim 1 wherein the lateral and medial side fins are thickened at their distal ends such that each side fin further comprises a stiffener member at the distal end thereof which is parallel to the longitudinal direction of the shoe portion.

11. The swim fin according to claim 1 wherein each of the lateral and medial side fins are curved in the longitudinal direction from front to rear so as to have a convex upper surface and a concave lower surface.

12. The swim fin according to claim 11 wherein the lateral and medial side fins extend linearly outwardly from the shoe portion to their distal ends.

13. The swim fin according to claim 1 wherein rears of the lateral and medial side fins are spaced higher than fronts thereof above a plantar plane defined by the sole of the shoe portion.

14. The swim fin according to claim 1 wherein a rear of the lateral fin extends further rearward than a rear end of the medial fin.

15. The swim fin according to claim 1 wherein the front ends of the lateral and medial side fins follow a common curved path across a width of the swim fin which is substantially aligned with and parallel to the front end of the shoe portion.

16. The swim fin according to claim 1 wherein the heel band is adjustable in length such that the prescribed length of the receptacle is adjustable.

17. The swim fin according to claim 1 wherein the upper includes a strap member which is adjustably secured between the lateral side and the medial side such that a maximum circumference of the receptacle defined by the shoe portion is adjustable.

18. The swim fin according to claim 1 wherein the upper of the shoe portion includes a gusset of resilient material supported therein such that a circumference of the receptacle defined by the lateral side, the medial side, the upper and the sole is resiliently adjustable.

19. The swim fin according to claim 18 wherein the upper of the shoe portion further includes a strap member which is adjustably secured between the lateral side and the medial side such that a maximum circumference of the receptacle defined by the shoe portion is defined by the strap member, the strap member being supported externally across the gusset of resilient material.

20. A swim fin wearable on a foot of a user comprising:

a shoe portion having a sole for receiving part of the foot thereon and an upper supported spaced above the sole by a lateral side and a medial side of the shoe portion that are connected between the sole and the upper for forming a receptacle having a prescribed length extending in a longitudinal direction from a rear end to a front end of the shoe portion for receiving the foot of the user between the rear end and the front of the shoe portion;

the shoe portion including a heel band at the rear end of the shoe portion at a location spaced rearwardly from a rear edge of the upper so as to define an ankle aperture between the upper and the heel band opening transversely to the longitudinal direction of the shoe portion so as to be arranged to receive the foot passed through the ankle aperture in order to be received in the shoe portion;

the shoe portion including a toe aperture at the front end opening in the longitudinal direction of the shoe portion;

the front end of the shoe portion, where the toe aperture is defined, being inclined relative to the longitudinal direction such that the shoe portion at the medial side extends further forwardly from the rear end than the lateral side of the shoe portion; and a lateral side fin and a medial side fin each on a corresponding one of the lateral and medial sides of the shoe portion so as to extend outwardly transversely to the longitudinal direction from the shoe portion to respective distal ends of the side fins spaced from shoe portion;

wherein the lateral and medial side fins each extend from a rear of the side fin at a location at or adjacent the ankle aperture of the shoe portion towards a front of the side fin that is rearward of the front end of the shoe portion;

wherein the lateral and medial side fins are spaced upwardly from the sole of the shoe portion across a length thereof between the fronts and the rears of the side fins; and wherein the rears of the lateral and medial side fins are spaced higher than the fronts thereof relative to a plantar plane defined by the sole of the shoe portion.

* * * * *